US009567135B1

(12) United States Patent
Spadaccini

(10) Patent No.: US 9,567,135 B1
(45) Date of Patent: Feb. 14, 2017

(54) EQUIPMENT STORAGE AND TRANSPORT APPARATUS

(71) Applicant: George M. Spadaccini, Boynton Beach, FL (US)

(72) Inventor: George M. Spadaccini, Boynton Beach, FL (US)

( * ) Notice: Subject to any disclaimer, the term of this patent is extended or adjusted under 35 U.S.C. 154(b) by 0 days.

(21) Appl. No.: 14/827,906

(22) Filed: Aug. 17, 2015

(51) Int. Cl.

| | |
|---|---|
| ***A47C 7/62*** | (2006.01) |
| ***A47C 13/00*** | (2006.01) |
| ***B65D 69/00*** | (2006.01) |
| ***B65D 71/00*** | (2006.01) |
| ***B65D 25/00*** | (2006.01) |
| ***B65D 90/00*** | (2006.01) |
| ***B65D 1/40*** | (2006.01) |
| ***B65D 3/28*** | (2006.01) |
| ***A45F 4/00*** | (2006.01) |
| ***B65D 25/20*** | (2006.01) |
| ***A47C 9/00*** | (2006.01) |
| ***B65D 1/14*** | (2006.01) |
| ***B65D 25/28*** | (2006.01) |
| ***B65D 85/00*** | (2006.01) |

(52) U.S. Cl.
CPC ..... *B65D 25/20* (2013.01); *A47C 9/00* (2013.01); *B65D 1/14* (2013.01); *B65D 25/2867* (2013.01); *B65D 85/70* (2013.01)

(58) Field of Classification Search
CPC ..... B65D 25/20; B65D 1/14; B65D 25/2867; B65D 85/70; A47C 9/00
USPC ..... 297/188.08, 188.09, 188.12, 188.13; 43/54.1; 220/694, 735; 206/216, 223, 206/315.1, 315.11, 315.9, 315.91, 579; 190/8
See application file for complete search history.

(56) References Cited

U.S. PATENT DOCUMENTS 469,107 A * 2/1892 Weatherly ..... B65D 51/246 297/188.09 X
2,326,414 A * 8/1943 Thompson ..... B65D 7/00 206/503

(Continued)

OTHER PUBLICATIONS

Monkeysports, Inc., Homerun Monkey, Diamond Bucket Sleeve, website, Copyright© 1999-2015 Monkeysports, Inc.All Rights Reserved. Homerun Monkey® and homerunmonkey.com® are Operated by and are Trademarks of Monkeysports, Inc. About SSL Certificates, pp. 1-3.

(Continued)

*Primary Examiner* — Rodney B White
(74) *Attorney, Agent, or Firm* — Glenn E. Gold; Glenn E. Gold, P.A.

(57) ABSTRACT

An equipment storage and transport apparatus includes a bucket having an interior chamber to store and carry items of equipment, a handle terminating at opposite ends being attached at opposite upper first locations on the bucket, cup-shaped support members attached at opposite lower second locations on the bucket angularly displaced from the first locations, loop-shaped retainer members attached at opposite upper third locations on the bucket spaced above the second locations and angularly displaced from the first locations, and a seat on the bucket bottom for the user to sit on when the bucket is inverted. The handle is configured to enable a user to grip it in order to lift and carry the bucket. The support members are configured to receive and hold the ends of elongated equipment items. The retainer members are configured to position the elongated equipment items upright relative to the support members.

20 Claims, 7 Drawing Sheets

(56) References Cited

U.S. PATENT DOCUMENTS 2,919,169 A * 12/1959 Jackson ..... A01K 97/22 297/188.08 X
3,010,775 A * 11/1961 Giovannelli ..... A63B 55/60 280/47.19
3,114,574 A * 12/1963 Pryale ..... A47J 36/06 297/188.1 X
3,128,905 A * 4/1964 Hesslein ..... A45C 13/22 220/760
3,499,244 A * 3/1970 Malone ..... A01K 97/05 43/56
3,531,136 A * 9/1970 Mobley ..... B62B 1/14 280/30
3,695,742 A * 10/1972 Allen ..... A47B 69/00 108/14
3,751,845 A * 8/1973 van Leeuwen ..... A01K 97/05 297/188.09 X
3,797,695 A * 3/1974 Law ..... A47C 9/10 297/188.1 X
3,869,137 A * 3/1975 Byrom ..... A63B 55/60 211/14
4,067,607 A * 1/1978 Battles ..... A01K 97/22 297/462
4,128,170 A * 12/1978 Elliott ..... A01K 97/04 190/111
4,210,363 A * 7/1980 Taipalus ..... A47C 9/10 190/8
4,227,710 A * 10/1980 Laub ..... A63B 69/0002 211/60.1
4,295,680 A * 10/1981 Grasso ..... A01K 97/22 297/188.09 X
4,331,214 A * 5/1982 Darby ..... G10K 11/26 181/208
4,353,182 A * 10/1982 Junkas ..... A01K 97/06 206/315.11
4,361,356 A * 11/1982 Tunick ..... A47C 13/00 206/523
4,379,587 A * 4/1983 Duncan ..... A01K 97/01 297/188.09 X
D272,481 S * 1/1984 Balling ..... D34/15
4,436,340 A * 3/1984 Hernandez ..... A01K 97/10 297/188.09
4,487,135 A * 12/1984 Van Ryn ..... B25H 3/00 297/188.09 X
4,538,862 A * 9/1985 Chandler ..... A47F 3/00 312/184
4,793,532 A * 12/1988 Cash ..... A45C 7/0095 206/315.1
4,845,881 A * 7/1989 Ward ..... A01K 97/22 43/21.2
4,846,076 A * 7/1989 Menges, Sr. ..... A01K 97/22 297/188.09 X
4,907,840 A * 3/1990 Hawkins ..... A47J 43/26 297/188.09 X
4,968,048 A * 11/1990 Lortie ..... A63B 71/0045 150/154
5,054,625 A * 10/1991 Foley ..... A47F 7/0028 211/60.1
5,131,179 A 7/1992 McEwen
5,170,516 A * 12/1992 Davison ..... A47K 11/06 297/188.09
5,172,642 A * 12/1992 Iannuzzelli ..... A47B 7/02 297/188.09 X
5,224,602 A * 7/1993 Bettles ..... A63B 71/0045 206/315.1
D340,565 S * 10/1993 Klopfenstein ..... D34/15
5,271,520 A * 12/1993 McAfee ..... A01K 97/06 206/315.11
5,303,500 A * 4/1994 Luukonen ..... A01K 97/01 206/315.11
5,319,877 A * 6/1994 Hagan ..... A01K 97/06 43/54.1
5,386,922 A * 2/1995 Jordan ..... A01K 97/06 206/373
5,429,265 A * 7/1995 Maire ..... B25H 3/00 206/372
5,441,163 A * 8/1995 Carrasco ..... B25H 3/06 206/373
5,471,779 A * 12/1995 Downey ..... A01K 97/22 206/315.11
5,547,098 A * 8/1996 Jordan ..... A01K 97/06 206/373
5,586,805 A * 12/1996 Rinehart ..... A47C 9/10 297/188.09 X
5,634,291 A * 6/1997 Pham ..... A01K 97/05 43/56
5,659,995 A * 8/1997 Hoffman ..... A01K 97/06 220/504
5,695,067 A * 12/1997 Harvey ..... A45C 13/02 206/315.1
5,730,285 A * 3/1998 Sheehan ..... A63B 55/00 206/315.2
5,755,057 A * 5/1998 Dancer ..... A01K 97/06 206/315.11
5,845,780 A * 12/1998 Allen ..... A45C 3/00 190/110
5,938,276 A * 8/1999 Munoz ..... A47C 7/002 297/188.08
5,970,651 A * 10/1999 Torkilsen ..... A01K 97/01 297/188.09 X
5,975,293 A * 11/1999 Fowler ..... A63B 71/0045 206/315.1
6,102,217 A * 8/2000 Mathy ..... A47B 81/002 211/188
6,199,718 B1 * 3/2001 Ellis ..... B44D 3/126 220/735 X
6,494,468 B1 * 12/2002 Inge ..... A63B 71/0045 206/315.1
6,550,860 B2 * 4/2003 Lombardi ..... A47C 9/08 297/188.09 X
6,663,119 B2 * 12/2003 White ..... A63B 47/002 280/47.131
6,705,463 B1 * 3/2004 Bucholtz ..... B65D 43/162 206/315.9
6,729,066 B1 * 5/2004 Howley ..... A01K 97/05 43/54.1
6,820,364 B1 * 11/2004 Tyson ..... A01K 97/04 220/735
6,883,268 B2 * 4/2005 Fraser ..... A01K 97/22 206/315.11
7,055,907 B1 * 6/2006 Tilby ..... A47C 7/021 297/224
7,255,658 B1 8/2007 VanKuiken et al.
7,278,539 B2 10/2007 Souza
7,305,793 B1 * 12/2007 Macdonald ..... A01K 97/06 206/315.11
7,328,813 B2 * 2/2008 Pfister ..... B65D 25/04 43/54.1
7,337,901 B2 * 3/2008 Phillips ..... A47J 47/16 220/735 X
7,341,314 B1 * 3/2008 Boyd ..... A47C 9/10 297/188.09
7,467,590 B1 * 12/2008 Meller ..... A47B 37/00 297/188.09 X
7,549,697 B1 * 6/2009 Long ..... A01K 97/20 297/188.12
7,559,423 B2 * 7/2009 Vosloo ..... A45C 11/00 206/315.1
7,604,290 B1 * 10/2009 Giordano ..... A47C 3/32 297/188.09 X
7,712,752 B2 * 5/2010 Horning ..... A47B 81/00 280/47.19
7,997,594 B1 * 8/2011 Mortazavi ..... B62B 1/008 206/315.9
8,061,723 B1 11/2011 Carroll et al.
8,177,271 B2 * 5/2012 Zats ..... A63B 47/02 211/14

(56) References Cited

U.S. PATENT DOCUMENTS

| | | | | |
|---|---|---|---|---|
| 8,640,866 | B1 * | 2/2014 | Dow | A63B 55/10 206/315.1 |
| 8,806,803 | B1 * | 8/2014 | Mitchell | A01K 97/05 206/315.11 |
| 9,072,382 | B2 * | 7/2015 | Johansson | A47C 4/021 |
| 9,078,526 | B1 * | 7/2015 | Kammeyer | A47C 13/00 |
| 9,192,279 | B1 * | 11/2015 | Valle | A47L 13/58 |
| 9,314,008 | B2 * | 4/2016 | DeSpiegelaere | A01K 97/06 |
| 2005/0011785 | A1 * | 1/2005 | Nish | A45C 3/00 206/315.1 |
| 2005/0252071 | A1 | 11/2005 | Urban | |
| 2006/0277814 | A1 * | 12/2006 | Lucky | A01K 97/10 43/54.1 X |
| 2007/0184921 | A1 | 8/2007 | Smith | |
| 2009/0149279 | A1 | 6/2009 | Fischer et al. | |
| 2010/0193379 | A1 * | 8/2010 | Matthews | A63B 47/02 297/188.08 X |
| 2010/0288908 | A1 | 11/2010 | McGraw | |
| 2011/0181081 | A1 * | 7/2011 | Williams | A45C 9/00 297/188.09 |
| 2013/0127128 | A1 | 5/2013 | Meidl | |
| 2014/0331543 | A1 * | 11/2014 | Hancock | A01K 97/01 43/17 |
| 2015/0001900 | A1 * | 1/2015 | Wang | A47C 3/16 297/188.09 |
| 2016/0114237 | A1 * | 4/2016 | Garcia, Jr. | A63B 71/0036 206/315.1 |
| 2016/0184675 | A1 * | 6/2016 | Sykes | A63B 55/00 206/579 |

OTHER PUBLICATIONS

Baseball Rampage LLC.Mizuno Organizer Coaches Bucket G2, Copyright© 2015 Baseball Rampage, a division of PCPD, LLC., pp. 1-2.

* cited by examiner

EQUIPMENT STORAGE AND TRANSPORT APPARATUS

FIELD OF THE INVENTION

The present invention relates to recreational aids and more particularly, is concerned with an equipment storage and transport apparatus, particularly, for sports equipment.

BACKGROUND OF THE INVENTION

In the sports of baseball/softball, field hockey and lacrosse, various sizes of bats and long-handled sticks as well as of balls are employed. In the sport of fishing, various lengths of fishing rods and poles as well as varieties of fishing accessories are employed.

An organized way to both store and transport these items is highly desirable as a matter of both efficiency and convenience so as to avoid their mishandling. Some users have a propensity toward disorganized storage of these items during their periods of non-use which results in their being mislaid and a search undertaken to find them before they can be used again. Also, manual transport and handling of these items as separate pieces is an awkward practice that may result in their being dropped and lost before reaching their intended destination.

Accordingly, there remains a need in the art for an innovation that will overcome the deficiencies of past approaches and the problems that remain unsolved.

SUMMARY OF THE INVENTION

The present invention is directed to an innovation that overcomes the deficiencies of the known art and the problems that remain unsolved by providing an equipment storage and transport apparatus, particularly, for sports equipment.

In one aspect of the present invention, an equipment storage and transport apparatus includes:

- a bucket having an interior chamber to store and carry equipment items therein;
- a handle terminating at a pair of opposite ends being attached at opposite first locations on the bucket and configured to enable a user to grip the handle and then lift and carry the bucket;
- at least one support member attached at a second location on the bucket being displaced from the opposite first locations of the opposite ends of the handle and configured to receive and hold an end of an elongated equipment item; and
- at least one retainer member attached at a third location on the bucket being displaced above the second location of the support member and configured to position the elongated equipment item substantially upright relative to the support member.

In another aspect of the present invention, an equipment storage and transport apparatus includes:

- a bucket having a bottom wall and a barrel-shaped side wall attached to a periphery of the bottom wall and extending upwardly therefrom such that together the bottom and side walls define an interior chamber having an open top end and being adapted to receive at least equipment items to be stored and carried therein;
- a handle formed by an elongated member terminating at a pair of opposite ends attached to opposite upper portions of the side wall of the bucket at opposite first locations thereon, the elongated member of the handle being configured to enable a user to grip the handle and then lift and carry the bucket;
- a pair of support members attached to opposing lower portions of the side wall of the bucket at opposite second locations thereon being displaced below, and angularly from, the opposite first locations of the opposite ends of the handle, the support members each being configured to receive and hold an end of an elongated equipment item; and
- a pair of retainer members attached to opposite upper portions of the side wall of the bucket at opposite third locations thereon being spaced above the opposite second locations of the support members and angularly about the side wall of the bucket from the opposite first locations of the opposite ends of the handle, the retainer members each being configured to position an elongated equipment item substantially upright relative to a respective one of the support members.

In another aspect of the present invention, an equipment storage and transport apparatus includes:

- a bucket having a bottom wall and a barrel-shaped side wall attached to a periphery of the bottom wall and extending upwardly therefrom such that together the bottom and side walls define an interior chamber having an open top end and being adapted to receive at least equipment items to be stored and carried therein;
- a handle terminating at a pair of opposite ends being attached at opposite first locations on the side wall of the bucket and configured to enable a user to grip the handle and then lift and carry the bucket;
- at least one support member attached at a second location on the side wall of the bucket being displaced from the opposite first locations of the opposite ends of the handle and configured to receive and hold an end of an elongated equipment item;
- at least one retainer member attached at a third location on the side wall of the bucket being displaced above said second location of the support member and configured to position the elongated equipment item substantially upright relative to the support member; and
- a seat on the bottom wall of the bucket for the user to sit on when the bucket is inverted.

In another aspect of the present invention, the seat of the apparatus has a swivel attachment to the bottom wall of the bucket.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
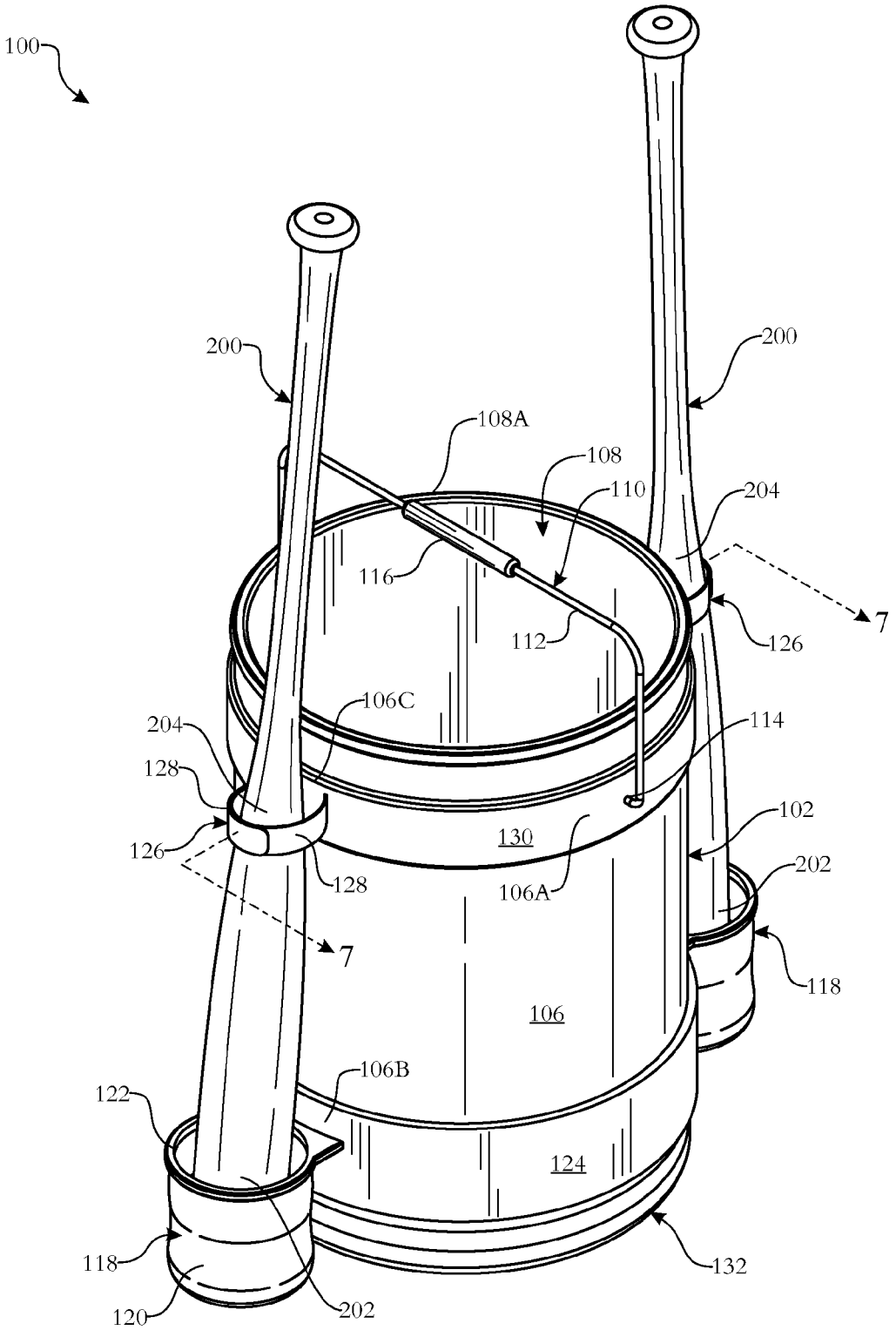
FIG. 1 presents an upper isometric view of an exemplary embodiment of an equipment storage and transport apparatus in accordance with aspects of the present invention, with a pair of baseball/softball bats being shown supported along opposite vertical sides of a bucket (or pail) of the apparatus.
Figure 2:
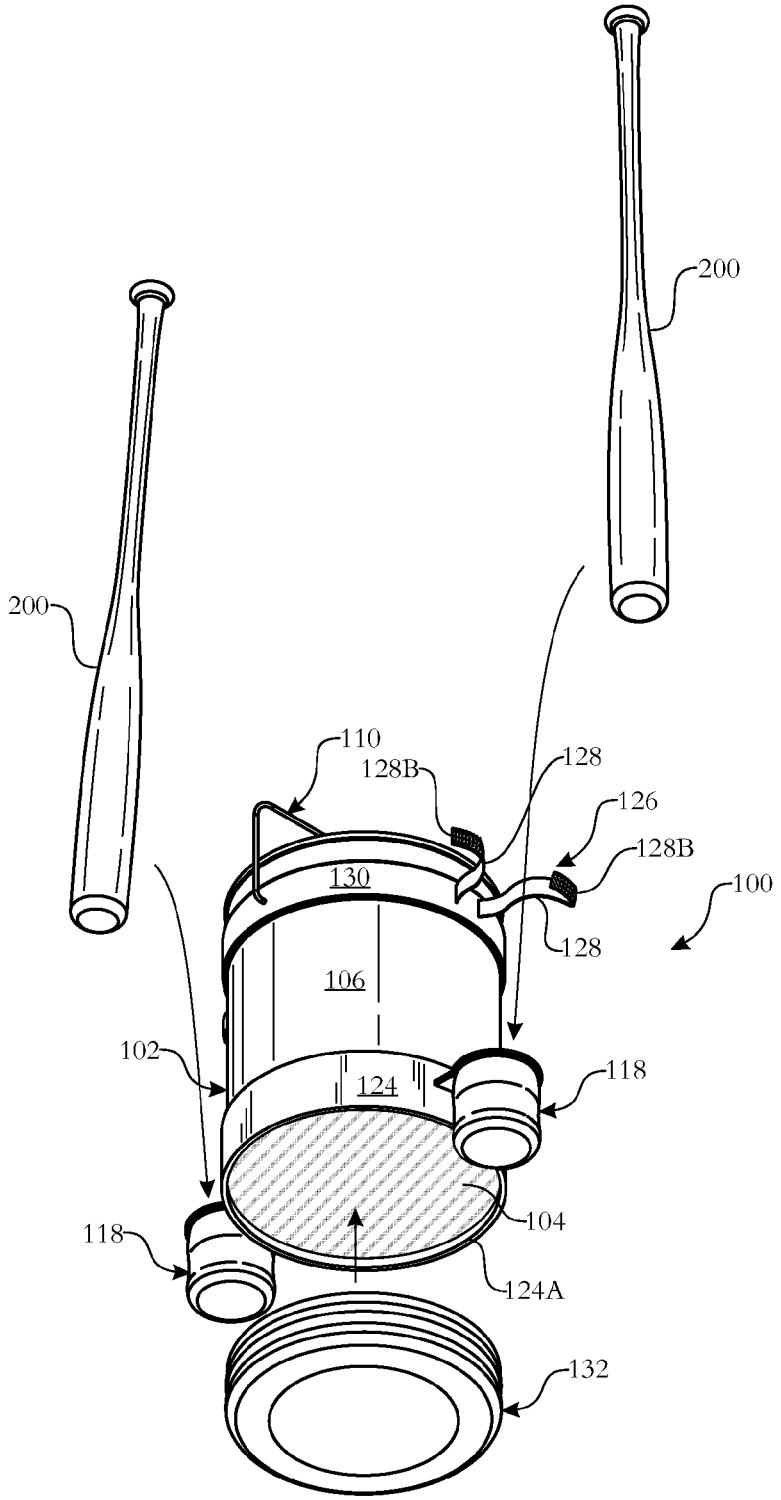
FIG. 2 presents a lower isometric exploded view of the equipment storage and transport apparatus originally introduced in FIG. 1.
Figure 3:
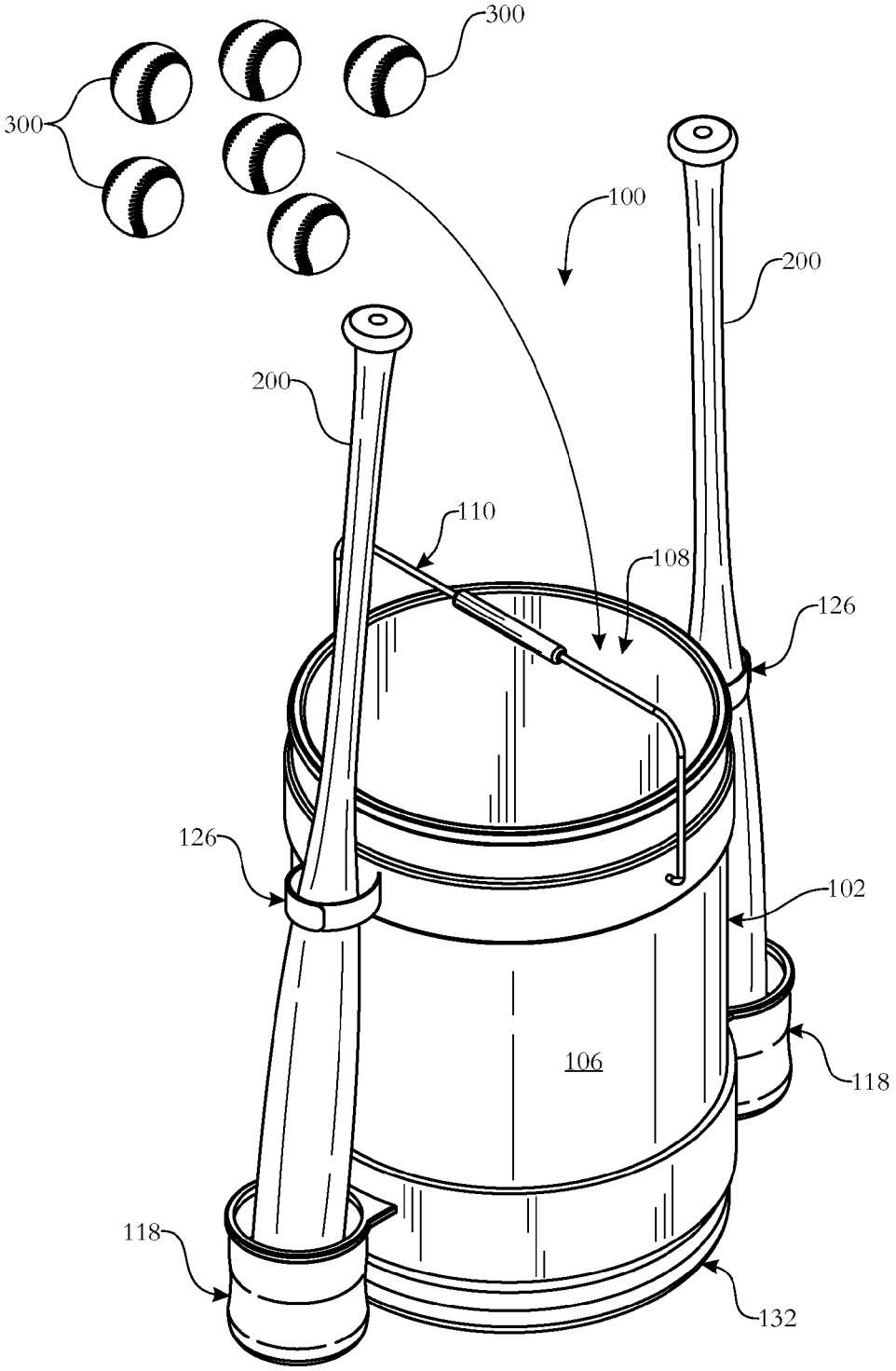
FIG. 3 presents an upper isometric view of the equipment storage and transport apparatus as originally introduced in FIG. 1, with a plurality of baseballs/softballs being shown that are intended to be placed in an interior compartment of the bucket of the apparatus.
Figure 4:
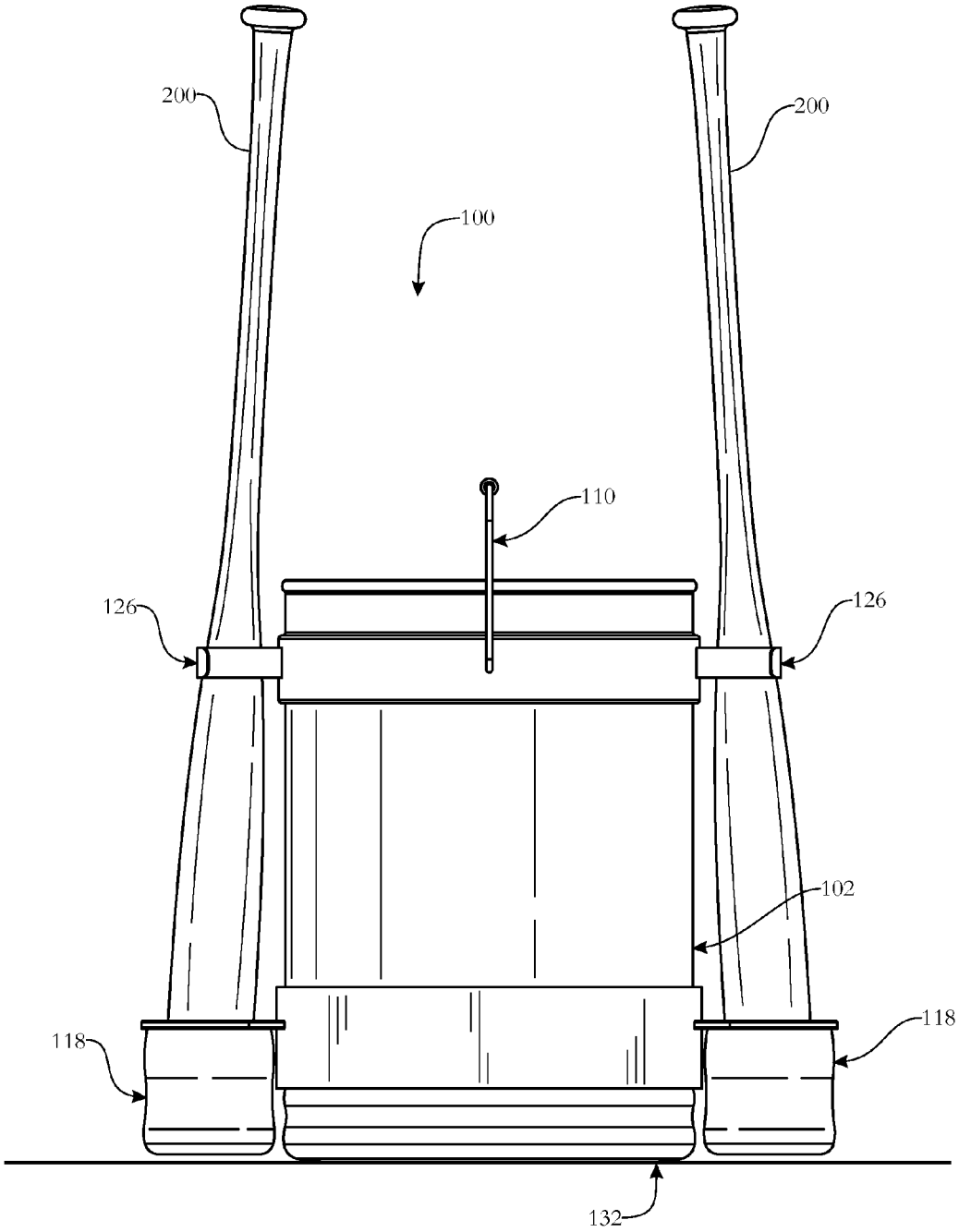
FIG. 4 presents a side elevation view of the equipment storage and transport apparatus originally introduced in FIG. 1.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1-4 and 7, there is illustrated an exemplary embodiment of an equipment storage and transport apparatus, generally designated 100, in accordance with aspects of the present invention. Particularly, the apparatus 100 is adapted for storage and transport of sports equipment, namely, bats 200 and balls 300 employed in baseball/softball, but also long-handled sticks and balls employed in field hockey and lacrosse. Alternatively, sports equipment such as rods and poles and accessories employed in fishing may be accommodated by the apparatus 100.

The equipment storage and transport apparatus 100 includes a bucket (or pail) 102 having a bottom wall 104 and a barrel-shaped side wall 106, more or less of cylindrical configuration, attached to a periphery of the bottom wall 104. The side wall 106 extends upwardly from the bottom wall 104 such that together they define an interior chamber 108 having an open top end 108A, adapting the bucket 102 to receive in the interior chamber 108 at least sports equipment items to be stored and carried by the apparatus 100. By way of example but not limitation, the bucket 102 may be made of known metal, such as steel or aluminum, or a plastic material, using known fabrication techniques.

The equipment storage and transport apparatus 100 also includes a handle 110 formed by an elongated member 112 terminating at a pair of opposite ends 114 of the handle 110 being attached to opposite upper portions 106A of the side wall 106 of the bucket 102 at opposite first locations thereon. By way of example but not limitation, the elongated member 112 of the handle 110 may have a U-shaped configuration, made of a known metal, such as steel or aluminum, or a plastic material, provided in a stiff rod-like construction, with the opposite ends 114 of the elongated member 112 being attached to an upper metal or plastic band 130 that forms an upper circumferential portion of the side wall 106 of the bucket 102. The handle 110 may also have a tubular cylindrical grip 116 disposed about the elongated member 112 approximately midway between opposite end portions thereof. Given such configuration and construction, the elongated member 112 of the handle 110 is configured to enable a user to grip the handle 110 and then lift and comfortably carry the bucket 102.

Figure 7:
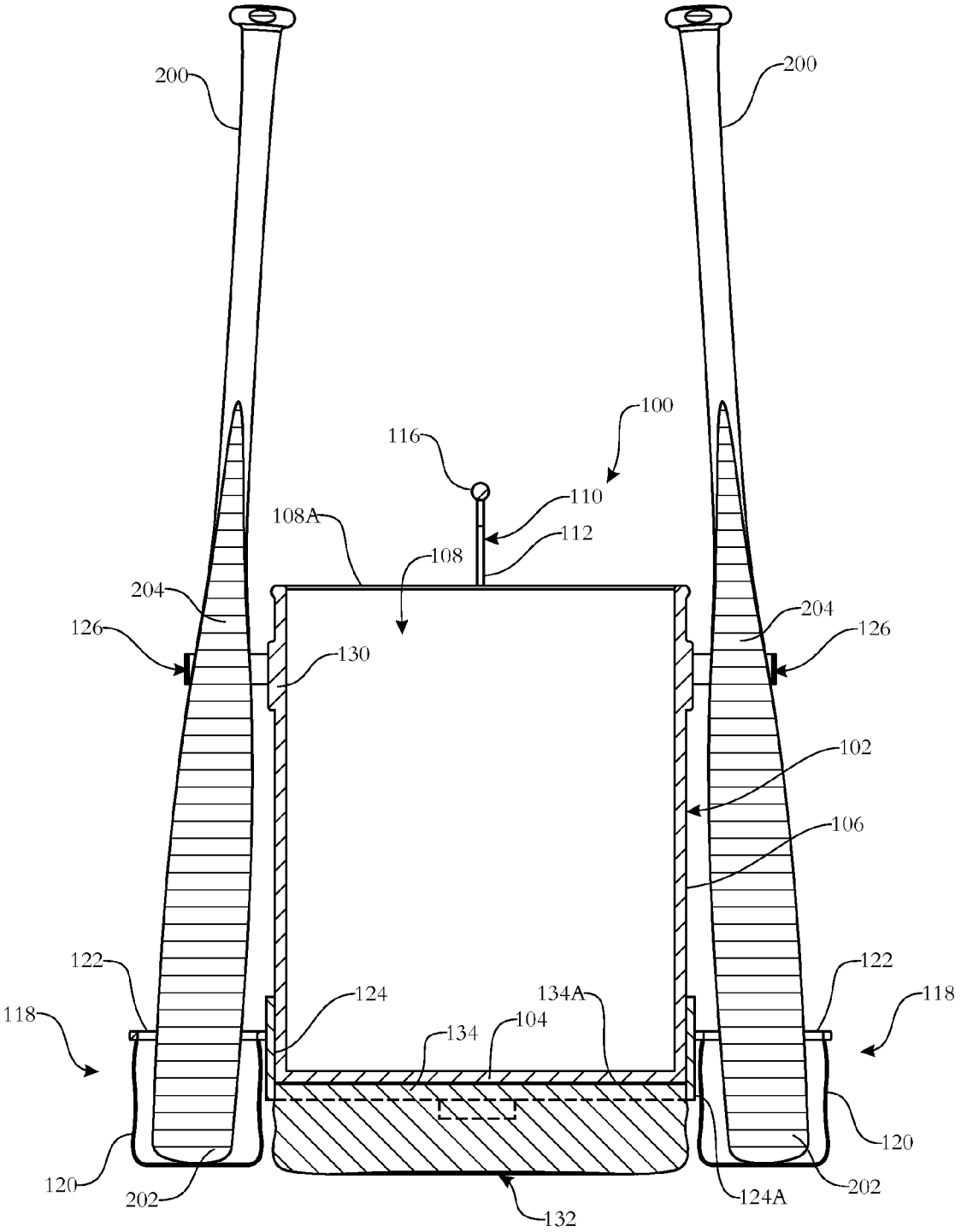
FIG. 7 presents a sectioned view of the equipment storage and transport apparatus, with the pair of bats, being taken along line 7-7 of FIG. 1, also depicting in dashed outline form a seat having a swivel attachment to the bottom of the bucket.

The equipment storage and transport apparatus 100 further includes at least one support member 118 attached at a second location on the bucket 102 being displaced, preferably angularly about the side wall 106 of the bucket 102, from the opposite first locations of the opposite ends 114 of the handle 110. The support member 118 is configured to receive and hold an end of an elongated equipment item, such as the end 202 of the baseball/softball bat 200. More particularly, the apparatus 100 includes a pair of the support members 118 attached to opposing lower portions 106B of the side wall 106 of the bucket 102 at opposite second locations thereon. The opposite second locations of the support members 118 are displaced below, and angularly spaced about the side wall 106 from, the opposite first locations of the opposite ends 114 of the handle 110. By way of example but not limitation, each of the support members 118 may be a structure in the form of a rigid or flexible cup-shaped bag 120 suspended from a rigid ring 122 fixedly attached to and projecting outwardly from a lower metal or plastic band 124 that forms a lower circumferential portion of the side wall 106 of the bucket 102. As seen in FIG. 7, the lower and upper bands 124, 130 forming the respective lower and upper circumferential portions of the side wall 106 of the bucket 102 are each greater in thickness than a middle circumferential portion of the side wall 106 extending between the lower and upper circumferential portions. Each support member 118 is thereby configured so as to receive and hold the end 202 of the elongated equipment item 200 so as to thereby vertically support or hold the elongated equipment item 200 by its lower end 202.

The equipment storage and transport apparatus 100 also includes at least one retainer member 126 attached at a third location on the bucket 102 being displaced directly above the second location of the support member 118, and preferably angularly spaced about the side wall 106 of the bucket 102 from the opposite first locations of the opposite ends 114 of the handle 110. The upper retainer member 126 is configured to position the elongated equipment item 200 substantially upright relative to the lower support member 118. More particularly, the apparatus 100 includes a pair of the retainer members 126 attached to opposing upper portions 106C of the side wall 106 of the bucket 102 at opposite third locations thereon being spaced directly above the opposite second locations of the support members 118 and angularly displaced about the side wall 106 of the bucket 102 from the opposite first locations of the opposite ends 114 of the handle 110. By way of example but not limitation, each of the retainer members 126 may be a flexible loop-shaped structure formed by a pair of flexible strips 128. Each of the strips 128 is fixedly attached at one end 128A to and projects outwardly from the metal or plastic band 130 that forms the upper circumferential portion of the side wall 106 of the bucket 102. Also, each of the strips 128 has an opposite free end 128B, for example with complementary patches of hook and loop material thereon, being detachably attachable to one another. Each retainer member 126 is thereby configured so as to receive therethrough and encompass a portion 204 of the elongated equipment item 200 spaced above the end 202 thereof so as to position it substantially upright relative to a respective one of the support members 118.

Figure 5:
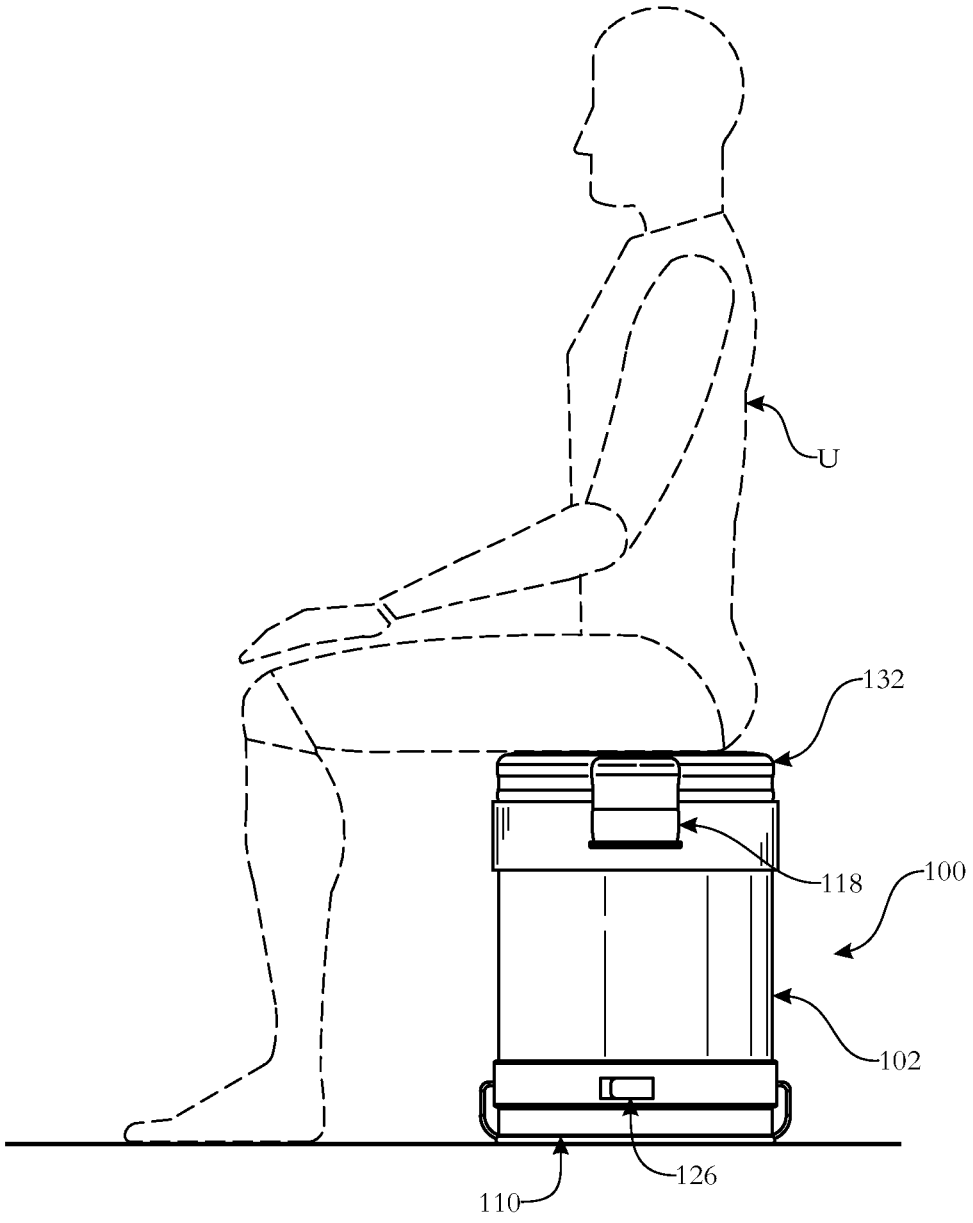
FIG. 5 presents an elevation view of the equipment storage and transport apparatus with the baseball/softball bats and balls removed, the apparatus inverted, and a user, shown in dashed line form, sitting on a seat formed by a cushion attached on a bottom of the bucket of the apparatus.
Figure 6:
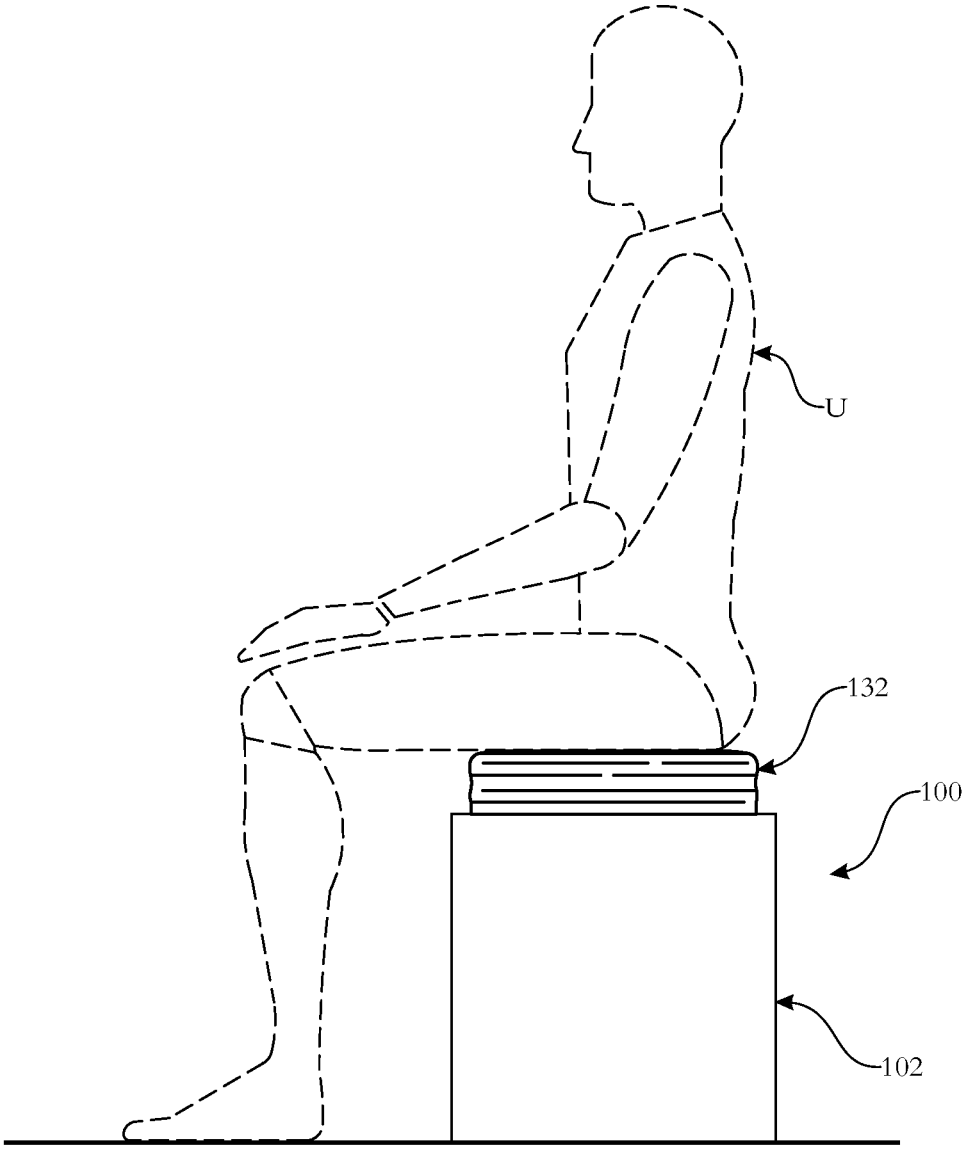
FIG. 6 presents another elevation view of the equipment storage and transport apparatus as seen in FIG. 5 but without showing the details of the bucket.

Referring now to FIGS. 1-4 and particularly to FIGS. 5-7, there is also illustrated a portable seat 132 of the apparatus 100 being secured on the bottom wall 104 of the bucket 102 for a user U (see FIGS. 5 and 6) to sit on when the bucket 102 is inverted. As seen dashed outline form in FIG. 7, the seat 132 may have a swivel attachment 134 to the bottom wall 104 of the bucket 102, allowing the seated user U to rotate relative to the bucket 102 while remaining seated. The seat 132 may employ any well-known appropriately constructed cushion. A lower portion 124A of the band 124 may overlap a portion of the outer circumferential surface 134A of the swivel attachment 134.

The bucket 102 and portable seat 132 may be provided in different sizes and colors. Also, the side wall 106 of the bucket 102 provides plentiful surface area on which to apply advertising, logos, and names of users, teams, etc.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. An equipment storage and transport apparatus, comprising:

a bucket having a bottom wall and a barrel-shaped side wall attached to a periphery of said bottom wall and extending upwardly therefrom such that together said bottom and side walls define an interior chamber of said bucket to store and carry equipment items therein;

spaced apart lower and upper bands forming respective lower and upper circumferential portions of said side wall of said bucket, wherein said upper band is thicker than the thickness of the bucket sidewall, and wherein the combined thickness of said lower band and said bucket sidewall is thicker than a middle circumferential portion of said side wall of said bucket extending between said lower and upper circumferential portions;

spaced apart lower and upper bands forming respective lower and upper circumferential portions of said side wall of said bucket that are each greater in thickness than a middle circumferential portion of said side wall of said bucket extending between said lower and upper circumferential portions:

a handle terminating at a pair of opposite ends being attached at opposite first locations on said upper band of said side wall of said bucket, said handle being configured to enable a user to grip said handle and then lift and carry said bucket;

at least one support member attached at a second location on said lower band of said side wall of said bucket being displaced below, and angularly from, said opposite first locations of said opposite ends of said handle on said upper band of said side wall of said bucket, said at least one support member being configured to receive and hold an end of an elongated equipment item; and at least one retainer member attached at a third location on said upper band of said side wall of said bucket being displaced above said second location of said at least one support member and angularly about said upper band of said side wall of said bucket from said opposite first locations of said opposite ends of said handle, said at least one retainer member being configured to position the elongated equipment item substantially upright relative to said support member.

2. The apparatus of claim 1 wherein said at least one support member is cup-shaped so as to configure said support member to engage the end of the elongated equipment item.

3. The apparatus of claim 1 wherein said at least one retainer member is loop-shaped so as to configure said retainer member to encompass a portion of the elongated equipment item spaced from the end thereof.

4. The apparatus of claim 3 wherein said loop-shaped retainer member is formed by a pair of strips attached at said third location on said upper band of said side wall of said bucket, each of said strips having an end being detachably attachable to one another.

5. The apparatus of claim 1 wherein said interior chamber of said bucket has an open top end and is adapted to receive through said open top end the equipment items to be stored and carried therein.

6. The apparatus of claim 1 wherein said handle is formed by an elongated member terminating at said pair of opposite ends being attached at said opposite first locations on said upper band of said side wall of said bucket.

7. The apparatus of claim 6 wherein said elongated member of said handle has a U-shaped configuration.

8. The apparatus of claim 1 wherein said at least one support member comprises a pair of support members attached at opposite second locations on said lower band of said side wall of said bucket displaced below, and angularly from, said opposite first locations of said opposite ends of said handle on said upper band of said side wall of said bucket.

9. The apparatus of claim 8 wherein each of said support members is cup-shaped so as to configure said support members to engage ends of equipment items therein.

10. The apparatus of claim 1 wherein said at least one retainer member comprises a pair of retainer members attached at opposite third locations on said upper band of said side wall of said bucket spaced angularly about said bucket from said opposite first locations of said opposite ends of said handle on said upper band of said side wall of said bucket.

11. The apparatus of claim 10 wherein each of said retainer members is loop-shaped so as to configure each of said retainer members to encompass a portion of the elongated equipment item spaced from the end thereof.

12. The apparatus of claim 11 wherein each of said loop-shaped retainer members is formed by a pair of strips attached at said third location on said upper band of said side wall of said bucket, each of said strips having an end being detachably attachable to one another.

13. An equipment storage and transport apparatus, comprising:

a bucket having a bottom wall and a barrel-shaped side wall attached to a periphery of said bottom wall and extending upwardly therefrom such that together said bottom and side walls define an interior chamber having an open top end and being adapted to receive at least equipment items to be stored and carried therein;

spaced apart lower and upper bands forming respective lower and upper circumferential portions of said side wall of said bucket, wherein said upper band is thicker than the thickness of the bucket sidewall, and wherein the combined thickness of said lower band and said bucket sidewall is thicker than a middle circumferential portion of said side wall of said bucket extending between said lower and upper circumferential portions;

a handle formed by an elongated member terminating at a pair of opposite ends attached at opposite first locations on said upper band of said side wall of said bucket, said elongated member of said handle being configured to enable a user to grip said handle and then lift and carry said bucket;

a pair of support members attached at opposite second locations on said lower band of said side wall of said bucket being displaced below, and angularly from, said opposite first locations of said opposite ends of said handle on said upper band of said side wall of said bucket, said support members each being configured to receive and hold an end of an elongated equipment item; and a pair of retainer members attached at opposite third locations on said upper band of said side wall of said bucket being spaced above said opposite second locations of said support members and angularly about said side wall of said bucket from said opposite first locations of said opposite ends of said handle on said upper band of said side wall of said bucket, said retainer members each being configured to position an elongated equipment item substantially upright relative to a respective one of said support members.

14. The apparatus of claim 13 wherein said elongated member of said handle has a U-shaped configuration.

15. The apparatus of claim 13 wherein each of said support members is cup-shaped so as to configure said support member to engage the end of the elongated equipment item.

16. The apparatus of claim 13 wherein each of said retainer members is loop-shaped so as to configure said retainer member to encompass a portion of the elongated equipment item spaced from the end thereof.

17. The apparatus of claim 16 wherein each of said loop-shaped retainer members is formed by a pair of strips attached at said third location on said upper band of said side wall of said bucket, each of said strips having an end being detachably attachable to one another.

18. The apparatus of claim 13 further comprising a seat on said bottom wall of said bucket for the user to sit on when said bucket if inverted.

19. An equipment storage and transport apparatus, comprising:

a bucket having a bottom wall and a barrel-shaped side wall attached to a periphery of said bottom wall and extending upwardly therefrom such that together said bottom and side walls define an interior chamber having an open top end and being adapted to receive at least equipment items to be stored and carried therein;

a handle terminating at a pair of opposite ends being attached at opposite first locations on said side wall of said bucket and configured to enable a user to grip said handle and then lift and carry said bucket;

at least one support member attached at a second location on said side wall of said bucket being displaced from said opposite first locations of said opposite ends of said handle and configured to receive and hold an end of an elongated equipment item;

at least one retainer member attached at a third location on said side wall of said bucket being displaced above said second location of said support member and configured to position the elongated equipment item substantially upright relative to said support member; and a seat on said bottom wall of said bucket for the user to sit on when the bucket is inverted.

20. The apparatus of claim 19 wherein said seat has a swivel attachment to said bottom wall of said bucket.

* * * * *